US006644203B1

(12) United States Patent
Powell

(10) Patent No.: US 6,644,203 B1
(45) Date of Patent: Nov. 11, 2003

(54) EXPLOSIVE DEVICE AND METHOD OF USING SUCH A DEVICE

(76) Inventor: Kevin Mark Powell, 170 London Road, Dunton, Green, Kent TN13 2TA (GB)

( * ) Notice: Subject to any disclaimer, the term of this patent is extended or adjusted under 35 U.S.C. 154(b) by 13 days.

(21) Appl. No.: 10/030,067

(22) PCT Filed: Jun. 30, 2000

(86) PCT No.: PCT/GB00/02535

§ 371 (c)(1),
(2), (4) Date: Jun. 7, 2002

(87) PCT Pub. No.: WO01/02797

PCT Pub. Date: Jan. 11, 2001

(30) Foreign Application Priority Data

Jul. 2, 1999 (GB) ..... 9915586

(51) Int. Cl.[7] ..... F42B 3/00; F42B 12/00

(52) U.S. Cl. ..... 102/315; 102/502; 102/202.15; 102/275.12

(58) Field of Search ..... 102/302, 315, 102/202.12, 275.12

(56) References Cited

U.S. PATENT DOCUMENTS

| | | | | |
|---|---|---|---|---|
| 1,097,442 A | * | 5/1914 | Jones | 102/275.12 |
| 1,446,664 A | | 2/1923 | Saucier | |
| 2,416,077 A | | 2/1947 | Yuster | 102/20 |
| 2,656,003 A | | 10/1953 | Poulier | 181/5 |
| 2,674,945 A | | 4/1954 | Marsh | 102/28 |
| 2,972,948 A | | 2/1961 | Kray | 102/56 |
| 3,477,372 A | | 11/1969 | McFerrin et al. | 102/24 |
| 3,570,402 A | * | 3/1971 | Anderson et al. | 102/275.12 |
| 3,664,262 A | | 5/1972 | Rose et al. | 102/56 |
| 4,023,494 A | | 5/1977 | Barton et al. | 102/24 R |
| 4,085,679 A | * | 4/1978 | Webb et al. | 102/70 R |
| 4,187,782 A | | 2/1980 | Grace | 102/56 |
| 4,259,906 A | | 4/1981 | Krauch, Jr. et al. | 102/56 SC |

(List continued on next page.)

FOREIGN PATENT DOCUMENTS

| | | |
|---|---|---|
| CA | 934224 | 9/1973 |
| CH | 369 158 | 5/1963 |
| DE | 1 130 746 | 2/1962 |
| DE | 1 136 920 | 12/1963 |
| DE | 2 306 889 | 8/1974 |
| DE | 23 52 896 | 5/1975 |
| DE | 25 00 152 | 7/1975 |
| DE | 3405527 | 6/1985 |
| DE | 38 34 491 | 4/1990 |
| DE | 43 02 252 | 9/1993 |
| FR | 977 378 | 3/1951 |
| FR | 1525339 | 9/1968 |
| GB | 852428 | 10/1960 |
| GB | 1084972 | 9/1967 |
| GB | 2351797 | 1/2001 |
| WO | 80/01511 | 7/1980 |

OTHER PUBLICATIONS

Copy of the European Search Report dated Sep. 22, 1999.
Copy of the International Search Report dated Oct. 12, 2000.
Copy of the UK Search Report dated Sep. 22, 1999.
Copy of the European Search Report dated Dec. 5, 2000.

*Primary Examiner*—Peter A. Nelson
(74) *Attorney, Agent, or Firm*—Nields & Lemack

(57) ABSTRACT

An explosive device (10) comprising: and explosive charge body (12) including an explosive charge and detonator (21); a housing (22) attached to the explosive charge body (12); and a length of electrical or non-electrical non-pyrotechnic firing line (26) having a first (28) and second end (32) the majority of which is stored within the housing so as to permit progressive removal from the housing on pulling the first end (28) thereof, and which is attached at the second end (32) to the detonator (21). The explosive device (10) can be used in a versatile manner for avalanche control, can allow a degree of positioning after initial deployment and provide safe operation yet is easily handleable, readily deployed and compact, and negates the hazards associated with the use of pyrotechnic delay fuze.

21 Claims, 5 Drawing Sheets

U.S. PATENT DOCUMENTS

| | | | | | |
|---|---|---|---|---|---|
| 4,425,849 | A | * | 1/1984 | Jorgenson | 102/275.12 |
| 4,499,830 | A | | 2/1985 | Majerus et al. | 102/476 |
| 4,794,990 | A | | 1/1989 | Riggs | 166/902 |
| 4,817,529 | A | | 4/1989 | Schippers | 102/302 |
| 5,129,514 | A | * | 7/1992 | Lilley, Jr. | 102/202.12 |
| 5,259,317 | A | | 11/1993 | Lips | 102/307 |
| 5,392,712 | A | * | 2/1995 | Waldock | 102/275.12 |
| 5,654,521 | A | * | 8/1997 | McDaniel | 102/348 |
| 5,705,768 | A | | 1/1998 | Ey | 103/307 |
| 5,847,312 | A | | 12/1998 | Walters et al. | 102/309 |
| 5,872,326 | A | | 2/1999 | Manhart | 102/439 |
| 5,996,504 | A | * | 12/1999 | Lowery | 102/504 |
| 6,279,481 | B1 | * | 8/2001 | Schippers | 102/302 |
| 6,415,716 | B1 | * | 7/2002 | Sanford et al. | 102/302 |
| 6,439,099 | B1 | * | 8/2002 | Carlson et al. | 102/275.12 |

* cited by examiner

EXPLOSIVE DEVICE AND METHOD OF USING SUCH A DEVICE

This invention relates to an explosive device and method of using such a device of particular, but not exclusive, application to triggering avalanches in a controlled manner.

Avalanches can present a serious danger to people and property when triggered in an uncontrolled manner, whether by a natural cause such as the weather conditions or unintentionally as a result of human activity such as skiing or climbing. It has therefore become an established practice in many mountainous areas to maintain continuous programs of avalanche control.

Control techniques can be separated into two main categories; passive and active. Two examples of passive control include a preventative approach, with the construction of terraced steel barriers high on the mountain slopes to pin the snow layers and prevent slippage, and a protective approach, where massive ground based deflectors are constructed on lower parts of the mountain to divert avalanche debris from specific structures considered to be at risk. Active avalanche control techniques form part of a carefully organized and continuous process of weather system surveillance, local condition forecasting and a range of practical procedures designed to induce controlled artificial avalanche releases.

This practice of regularly triggering small, controlled releases is intended to minimise the build up of snow in known start zones which, if left, would eventually release naturally. Such natural releases of large volumes of snow can cascade to develop massive slides invariably causing extensive damage to services, infrastructure, property and people. People are injured and killed by avalanches every year, world wide.

This invention supports active methods of avalanche control and in particular the use of explosives to stimulate artificial avalanche release. Explosives are used extensively in this role and a wide range of delivery methods are employed to suit the prevailing operational environment. Some of the more common delivery techniques are described below.

Where start zones are inaccessible, the explosive charge can be delivered to the slope in the form of a projectile fired from a gun or mortar system where the projectile explodes on or shortly after impact. Short ranges (2 to 5 km) can be covered by gas gun projector systems such as the nitrogen driven avalauncher, used extensively in the U.S., Canada and Europe. Longer ranges demand high performance systems and military artillery pieces typical of the 105 mm howitzer and 106 mm recoilless rifles have been used in this role for many years. Accuracy remains a problem for both systems at the limits of their range performance. However, the most significant problem with the military gun systems currently in use is that the ammunition is now obsolete and ageing.

Although older military ammunition fuzes detonate upon impact (but almost certainly well below the surface in the case of snow pack), in fact, proximity air bursts above the surface produce the most effective avalanche release performance. However, with gun fired projectiles this can only be achieved with electronic proximity burst fuzes. The cost of such fuzing is both inhibitive and notoriously unreliable against light, dispersed mediums such as surface snow, the use of impact fuzing therefore continues.

A more recent approach, developed primarily for protection of road and rail routes in remote areas, involves a fixed installation bolted into the mountain side in close proximity to an avalanche start zone. The apparatus, known by its commercial name as Gaz-Ex, consists of a large divergent funnel down which a charge of inflammable gas is injected and ignited using a remote ratio command fire management system. The resultant shock wave emitted from the mouth of the funnel then stimulates the controlled release of small avalanches, the frequency being dictated by a combination of local weather surveillance and avalanche forecasting techniques.

Where sites are particularly inaccessible, or have become so due to heavy snow fall or are unsuitable for the use of gun systems and/or the installation of Gaz-Ex systems, helibombing is often employed. Helibombing involves dropping a bag of commercial explosive composition, typically ANFO, into the avalanche start zone from a helicopter. The charge is detonated via a length of pyrotechnic delay fuze which is ignited in the helicopter before release.

US-A-4,817,529 discloses a method for automatically positioning a blast charge at a predetermined position end height above the snow surface to achieve an air burst from the explosive charge. The charge is suspended below a small host. The hoist and charge assembly are attached to a fixed steel cable winch system that traverses the hoist and charge assembly across the slope to the desired firing position. The small hoist is then issued with a command to lower the charge until a senses contact with the snow, and raise it back to a pre-determined height above the snow surface. The charge is fitted with a pyrotechnic delay fuze with a long burn time to allow for the overall positioning sequence to be completed prior to detonation. This fixed system is useful for slopes with a known line of trigger points.

Most areas in ski resorts are accessible, including the mountain peaks, and this accessibility enables explosive charges to be delivered or placed by hand. The practice of hand charge operations is probably the most cast affective and extensively used method of avalanche control in many ski resorts but is carries with it obvious hazards in poor weather conditions. The hand charge is a relatively simple device consisting of a lightly cased (cardboard) explosive charge detonated by a length of capped pyrotechnic delay fuze. The fuze can either be ignited and the charge thrown into a preferred position or the charge can be pre-positioned above the surface on a bamboo stick before the fuze is ignited. In both cases, within the delay time, the operator must retire to a safe position before detonation occurs.

Perhaps the most undesirable characteristic of a pyrotechnic delay fuze is that once the fuze has been ignited the only quick way to de-fuze the device is to attempt to cut the fuze beyond the flame front. This is not acceptable practice, but may be the only option when faced with an emergency. However, once ignited and abandoned, irrespective of circumstances, detonation of the charge cannot be evened. These characteristics together with the difficulty, in adverse weather conditions, of detecting if a fuze has been properly ignited have led to injury and fatalities in the past.

Not surprisingly, more appropriate firing systems have been adopted by the majority of explosive user communities world wide. It is important to recognize, however, that the particularly awkward range of environmental conditions associated with avalanche control operations impose the continued use of pyrotechnic delay fuzes pending identification of a satisfactory alternative.

The present invention focuses on avalanche control operations using hand charges. It seeks to provide an explosive device which will extend the convenience and versatility of hand charge control techniques.

The present invention, according to a first aspect, provides an explosive device comprising: an explosive charge body including an explosive charge and a detonator; a housing; and a length of non-pyrotechnic firing line having a first end and a second and, one end being operatively connected to the detonator, the majority of which line is stored within the housing so as to permit progressive removal from the housing on pulling one of the ends thereof; and in which movement of the non-pyrotechnic firing line is restrained so as to prevent the one end of the non-pyrotechnic firing line being pulled away from and operatively disconnected from the detonator when the non-pyrotechnic firing line is pulled from the housing.

The explosive charge of such a device can be launched towards a desired site while tethering the end of the non-pyrotechnic firing line not connected to the detonator. The non-pyrotechnic firing line is restrained from being pulled from the detonator as the non-pyrotechnic firing line reaches its full extension. It also allows a degree of repositioning of the charge after initial charge deployment and provides instantaneous control over the decision to detonate the charge. The explosive device remains easy to handle, readily deployable and compact and avoids the use of the pyrotechnic delay fuze component The movement of the one end of the non-pyrotechnic firing line can be restrained by any convenient means, including for example, threading the non-pyrotechnic firing line through one or more holes in the charge body providing a tether between the non-pyrotechnic firing line and the charge body or fixing the non-pyrotechnic firing line to the outside of the charge body by meant of a tape, adhesive or other convenient fastening or fixing means.

The non-pyrotechnic firing line can consist of two basic types, a twisted pair of electrical conductors for connection to an electric detonator or a non-electric detonation transmission line. The latter is a known alternative initiation system to a slow-burn pyrotechnic fuze or electrical conductor consisting of a non-pyrotechnic firing line of flexible plastics tube with a bore whose inner surface is coated with an explosive composition. It is sometimes referred to as a "shook tube" as the explosive coating is detonated at one end of the shock tube and a detonation shock front propagates down and is fully contained within its interior until it reaches, and so detonates, the reception composition in the detonator cap.

Non-electric detonation transmission lines are preferred to avoid the hazards associated with inadvertent detonation due to stray radio-frequency fields.

The use of a non-pyrotechnic firing line means that it is known to the user that there is no possibility of a late detonation in the event of a misfire. Further, the non-pyrotechnic firing line should be chosen to be strong enough to support the weight of the charge ad it can be used to retrieve the explosive charge (typically about 1 kg in weight) in the event of such a misfire or used to haul the device into a more preferred location prior to the final decision to detonate the charge.

By storing the rum-pyrotechnic firing line in a housing in the manner described, the explosive charge can be deployed in a variety of ways including throwing by hand or by a launcher or by hand placing the explosive charge at the desired location and pulling the second end of the non-pyrotechnic firing line to a firing position.

The non-pyrotechnic firing line is preferably coiled within the housing, for example as a series of radially nested helices, to provide ready pulling from the housing. Other storage layering can be used.

Conveniently, an end of the non-pyrotechnic firing fine is attached to a tethering clip or tag to make it easier to grip in the hand or attach the end to a fixed anchor.

The non-pyrotechnic firing line may extend from within the housing and be fixed releasably to the outside of the housing or explosive charge body for convenience of handling prior to use and readying the device for deployment.

The housing may comprise a thin sleeve which is a slide-fit over the explosive charge body and retained in position by a strip of adhesive tape, but other means for storing the detonation transmission line in the device ready for deployment may be employed.

Any conveniently available explosive charge may be used to constrict the device, particularly shaped charges, bare blast charges, or various enhanced blast charge configurations.

In the letter two cases, the detonator may be embedded in the explosive charge in a number of different positions to achieve different output effects. In the case of the simple bare blast charge the non-pyrotechnic firing tine may be passed through the body of the explosive filling and passed back into the detonator cap well.

An elongated support, normally bamboo, may be attached to the explosive charge body to act as a standoff. Such a device may be used by positioning the support in the snow so the explosive charge is fixed in a desired position and, if necessary, orientation. The free end of the non-pyrotechnic firing line can then be pulled to the firing position from where the charge can be detonated.

A second aspect of the present invention is method of using the explosive device of the first aspect of the presets invention and comprises deploying the device at or near a desired location with the non-pyrotechnic firing line extending from the explosive charge to an initiation site.

The method may also include the optional step of adjusting the position and/or orientation of the device using the non-pyrotechnic firing fine prior to detonation and detonating the explosive charge.

The device may be hand-launched by the user or launched by any convenient launching device, such as a gas gun, riot gun or cross-bow. This allows the operator to stand well back from an unstable area during the placement operation.

In another method of use of the present invention, the explosive device is launched so the non-pyrotechnic firing line lies over a horizontal support, for example a cable, the vertical position of the device can then be adjusted by pulling back the non-pyrotechnic firing line until the desired height above the snow is achieved.

Embodiments of the explosive device and methods of using such devices, all according to the present invention, will now be described, by way of example only, with reference to the accompanying drawings, of which:

Figure 1:
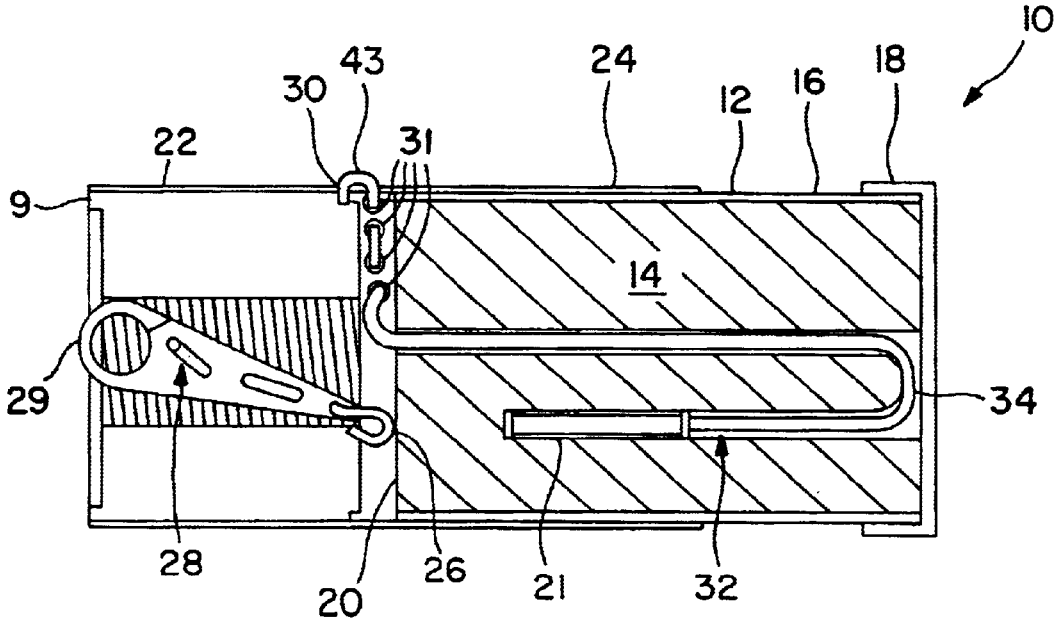
FIGS. 1 to 2 are diagrammatic, cross-sectional views of two explosive devices, each according to the present invention.

Referring to FIG. 1, an explosive device 10 has an explosive charge body 12. In this case a D90 hand charge manufactured by Dyno Nobel Americas, USA. It has an explosive charge 14 within a cylindrical case 16 capped at one end by cap 18 having a bare explosive surface at the other. A detonator 21 Is embedded in the charge 14.

A sleeve 22 of thin, waterproofed cardboard, a slide-fit over the case 16, is retained in position on the charge body by a circumferentially extending strip of adhesive tape 24.

A 23 m length of 3 mm diameter non-pyrotechnic firing line 26 (in this case Nobel Dynoline shock tube) manufactured by Pro Nobel Americas, USA, is coiled within the housing 22 as a series of radially nested helices. Other lengths may be used as required, typically 18 to 30 m. A first end 28 of the shock tube 26 extends from the last internal coil and terminates at an anti-snatch tag 28 to which it is secured. This first end 28, when assembled, is located, for transit purposes, inside the space within the shock tube coils. The second end 32 of the shock tube 28 extends from the detonator 21 to a recess 34 in the charge near the cap 18 and then loops back towards the open end of the charge filling 20. From there it passes radially outward to pass through a series of circumferentially spaced restraining holes 31 in the housing 22, before looping back into the interior of the housing 22 through hole 30 to start the outer helix of the coiled shock tube 26.

The coiled shock tube assembly is a push-fit into the housing 22 but is retained within the housing by a ring 9 fixed to the open end of the housing. The shock tube 26 is readily drawn from the housing 22 by pulling the tag attached to its first end 26 which can then be attached to a fixed anchor, to the operator of to the launcher system before launch of the complete assembly 10 to its desired location. The tag la optional.

Figure 2:
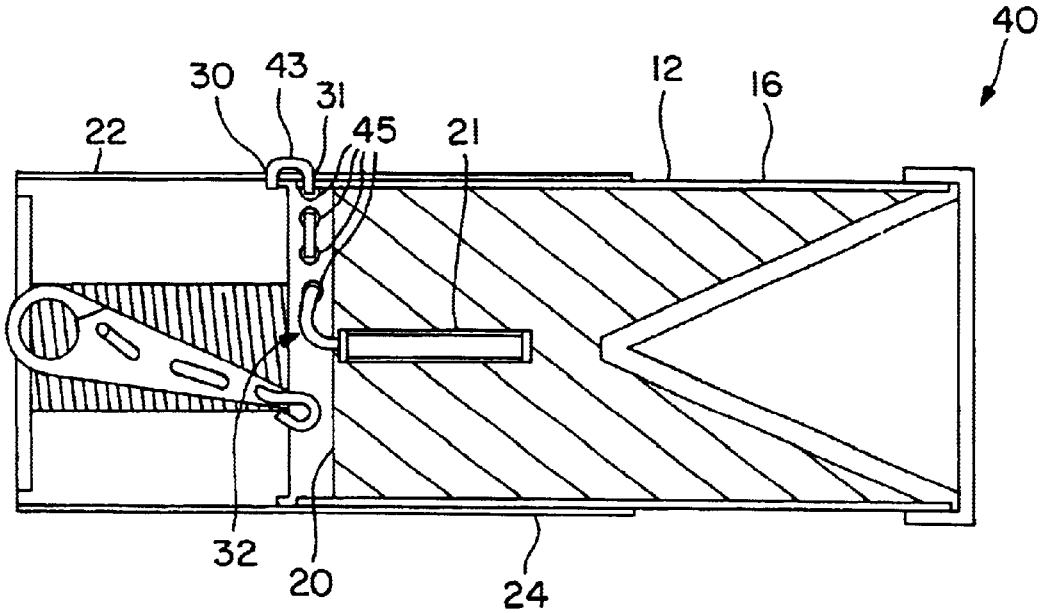

Referring now to FIG. 2, an explosive device is as that of FIG. 1 except the bare blast charge body is replaced by a shaped charge explosive body 40 of known type. Those parts in common with FIG. 1 have been given the same reference numerals.

In this case the detonator is positioned on the axis at the open end of the charge 20 and the second end of the shock tube passes through a series of restraining holes 46 in the casing 16 and aligned holes 31 in the housing 22 before looping back through hole 30 in the housing 22 to the interior of the housing 22.

It will be clear the present invention may be implemented using various types of explosive bodies which can be detonated by use of an electrical or non-electrical non-pyrotechnic firing line.

Figure 3:
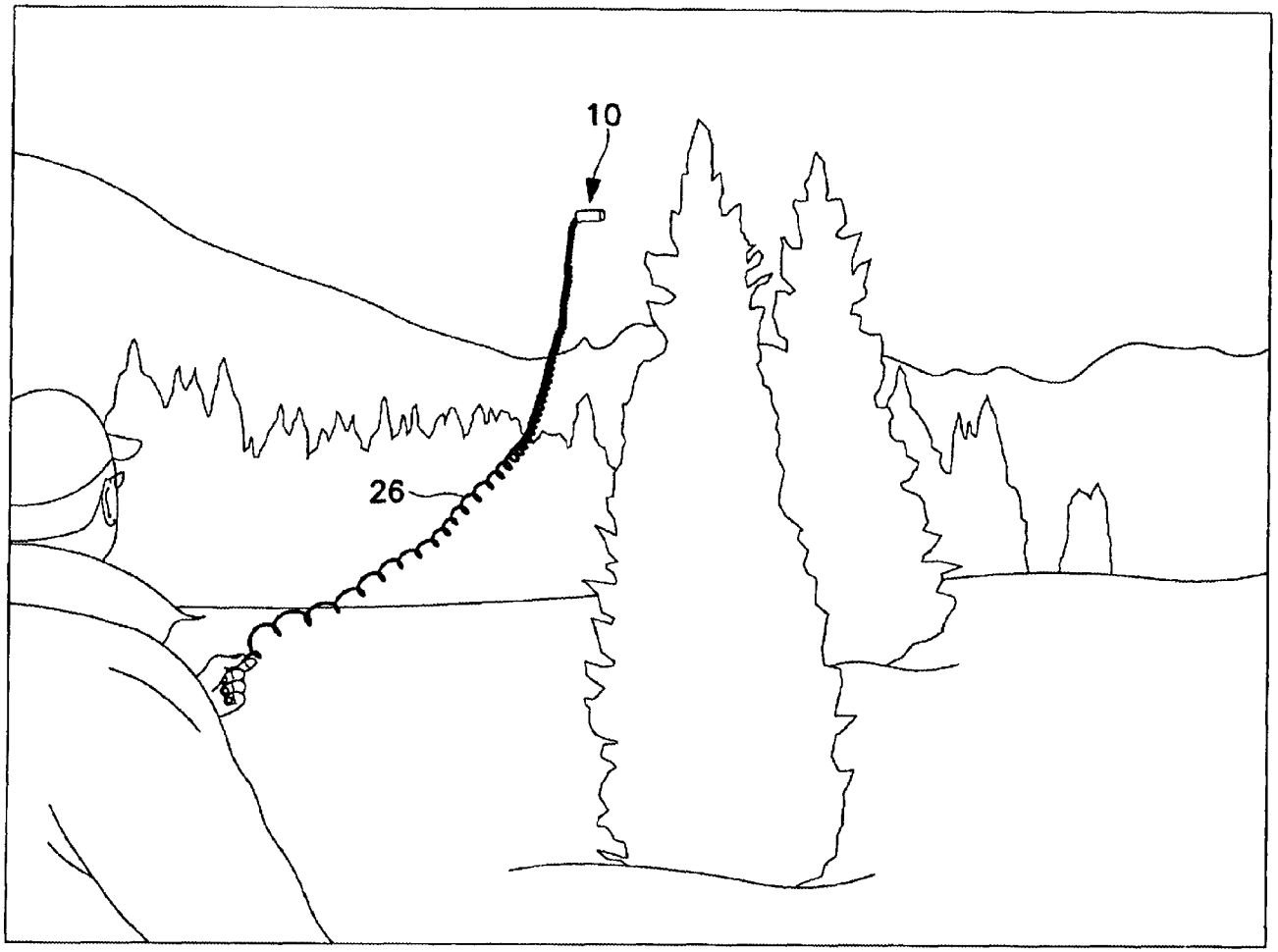
FIG. 3 is a photograph showing a hand thrown deployment of the explosive device of FIGS. 1 and 2.

FIG. 3 illustrates one example of a method of deployment of the device of FIG. 1. The first end 28 of the shock tube 26 is held by or attached to the operator and the device 10 launched by hand, the shock tube 26 being progressively pulled from the housing 22 of the device 10 during the flight of the device 10. An alternative method of launched deployment is to launch the device 10 using a mechanical or gas driven system whereupon a similar deployment of the shock tube 26 occurs. The shock tube 26 binds on the restraining holes 31 when fully deployed preventing the resultant "snatch" force being transmitted to the end of the shock tube connected to the detonator 21.

Once deployed the shock tube can be pulled to adjust the position and/or orientation of the device 10.

Figure 5:
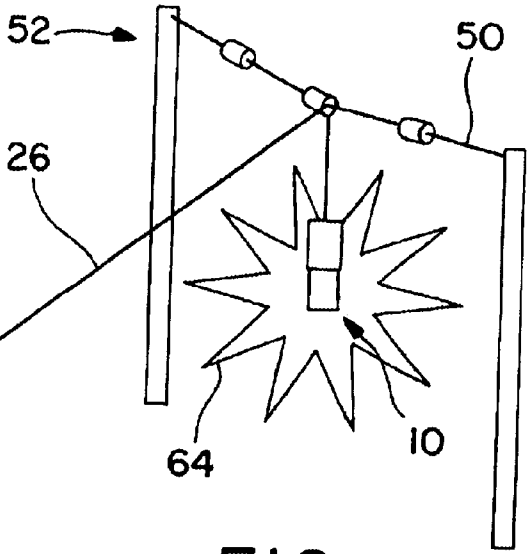
FIGS. 4 and 5 are diagrammatic views of a number of hand-thrown or launched deployments of the explosive device shown in FIG. 1.

The device 10 can be launched or thrown so the shock tube 26 lies over a horizontal support such as a cable 50 of a gantry 52, as shown in FIG. 5, positioned at a desired location. The shock tube 26 can then be used to lift the device to a desired position above the snow slab prior to detonation.

Figure 4:
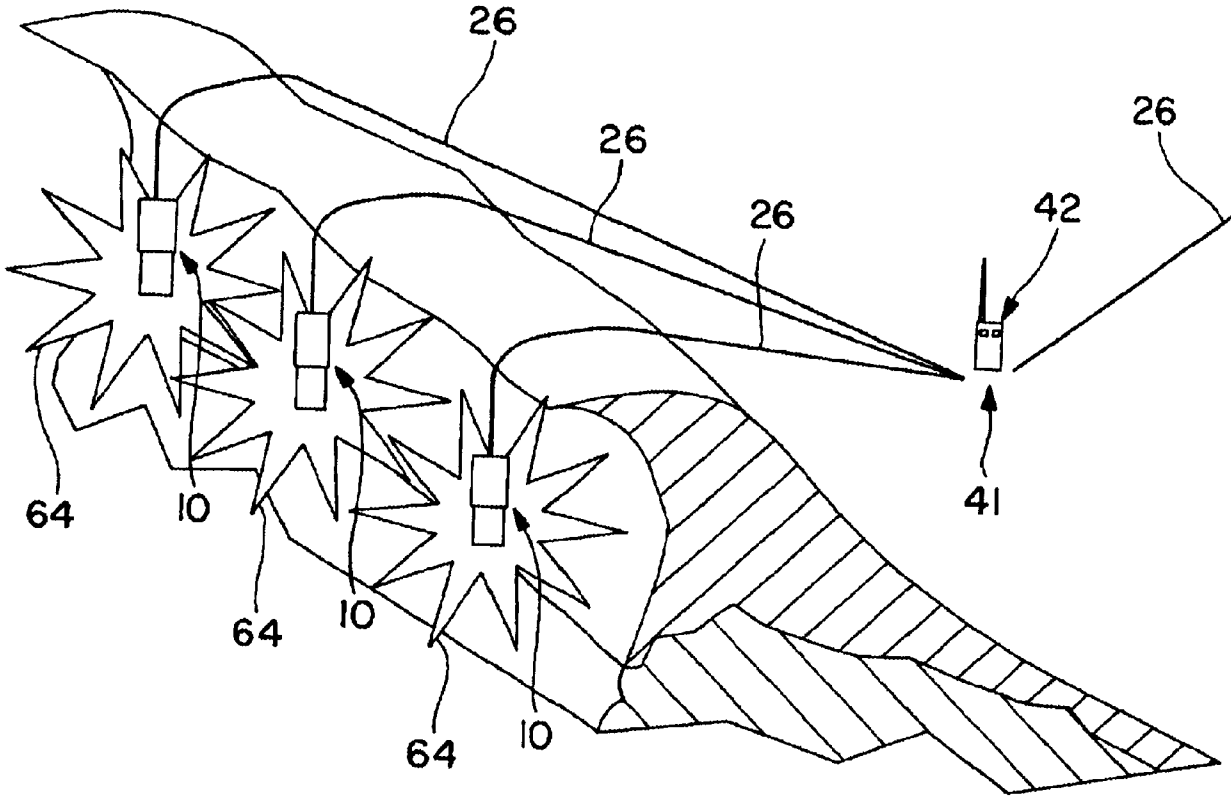

An example of hand-thrown or launched deployment of series of devices of FIG. 1 is shown in FIG. 4. The devices 10 have been hung over the line of a cornice build up, the shock tube 26 being used to set the depth of overhang of each charge before being tied off at the firing point. The detonators may embody different delays to provide successive detonations from a single initiation stimulus provided from the firing point 41. Omnidirectional blast emission produced by the bare blast charge 10 is shown by "star" shaped area 64.

In all methods described in this application, the initiation can be carried out by a user using a handset or by means of a remote receiver of a radio command fire system 42, for example, located et the firing point 41.

Figure 7:
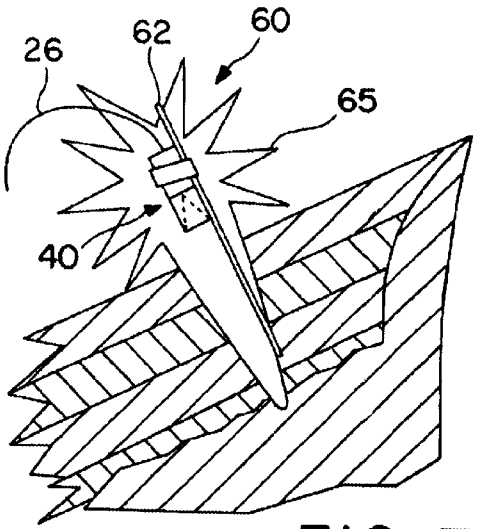
FIGS. 6 to 9 are diagrammatic views of further methods of deploying the device of FIG. 2
Figure 6:
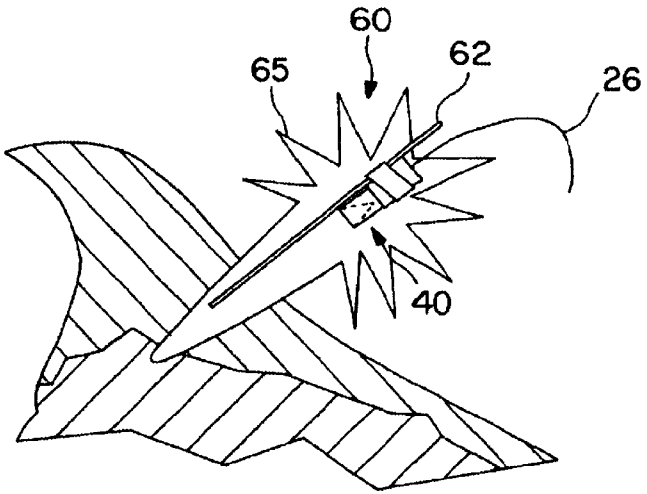
Figure 8:
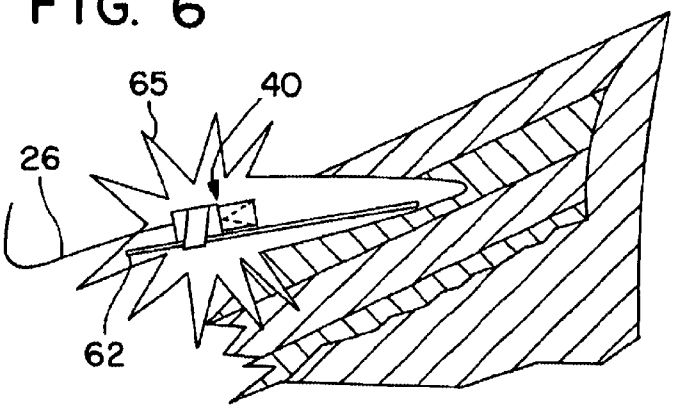

FIGS. 6 to 8 illustrate an explosive device 60 which is as device 40 of FIG. 2 but with a support stick 62 affixed to it so the device can be positioned and orientated as required on a snow slab. The highly focused blast emission produced by the enhanced blast charge 40 is shown by the extended "star" shaped area 65. They respectively illustrate the use of the device for cornice overhang removal with the device 60 providing combined air shock and deep penetration, slab blasting with the device providing combined air shock and deep penetration perpendicular to the snow slab, and slab blasting where the device is orientated to provide superficial disruption of the surface layer of a snow slab.

Figure 9:
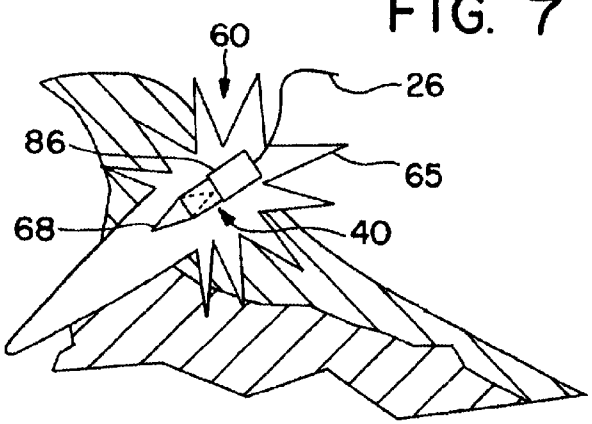

FIG. 9 shows a further embodiment of the present invention for cornice control. The device 66 is as the device 40 but includes a conical end cap 68 to aid penetration into the soft back of the cornice following remote delivery of the device from a short range launcher system.

Figure 10:
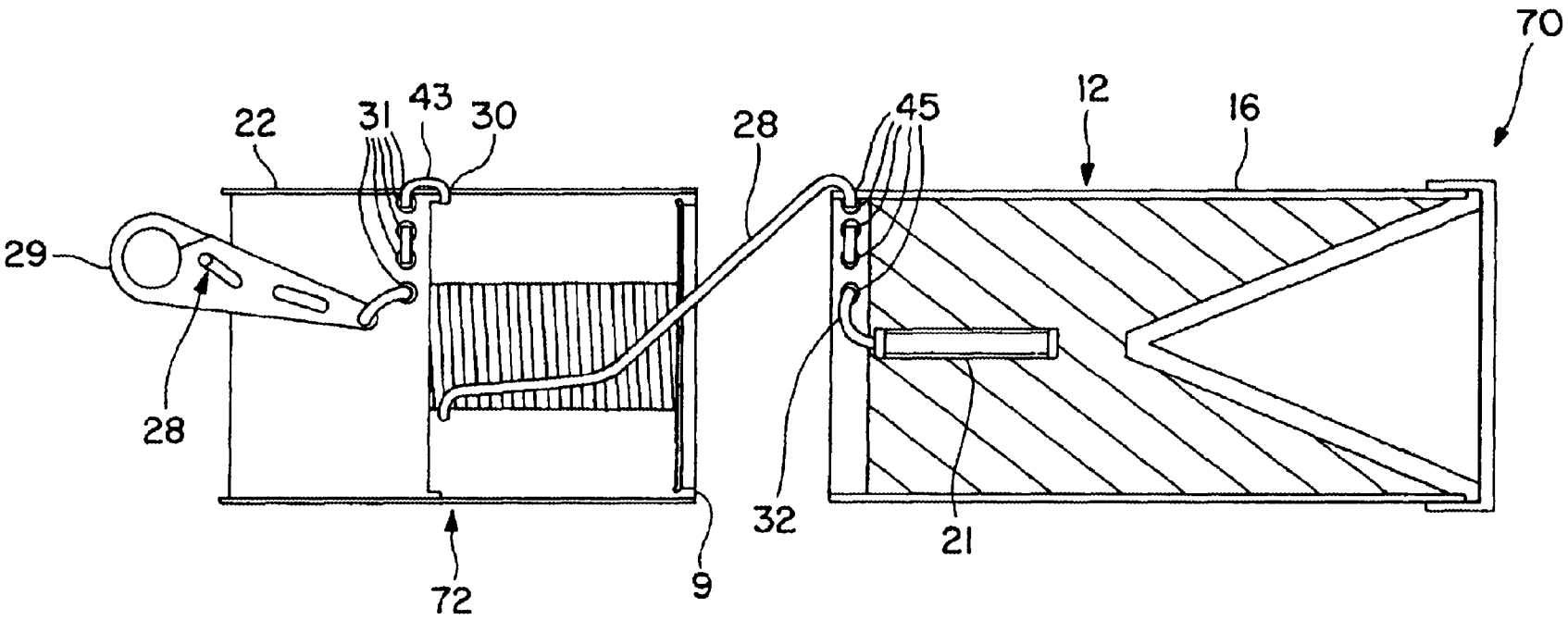
FIG. 10 is a diagrammatic, cross-sectional view of a further embodiment of the present invention.

FIG. 10 is a diagrammatic, cross-sectional view of a further embodiment of the present invention which has the same component parts as the device of FIG. 1 but the housing 22 has been rotated through 180° and the first and second ends of the shock tube 26 are now connected to the detonator 21 and tag 29, respectively.

The first end of the shock tube 26 is threaded through holes 46 to secure it to the charge case 16, the second end is threaded through holes 31 in the housing 22 to secure it to the housing 22.

This embodiment is used as follows. The explosive charge 12 is launched by any suitable method, as the device of FIG. 1, but the housing 22 is retained at the launching point and the shock tube 26 pulled from the housing 22 by the launched explosive charge 12. The tag 29 is again optional and used to aid anchoring the second end, and in this case, also the housing 22, at the launch site.

Variations in design and method of use applicable to the carrier described embodiments may also be adopted with this embodiment, so a shaped charge may be used.

What is claimed is

1. An explosive device comprising: an explosive charge body including an explosive charge and a detonator; a housing; and a length of non-pyrotechnic firing line having a first end and a second end, one end being operatively connected to the detonator, the majority of which line is stored within the housing so as to permit progressive removal from the housing on pulling one of the ends thereof; and in which movement of the no-pyrotechnic firing line is restrained so as to prevent the one end of the non-pyrotechnic firing line being pulled away from and operatively disconnected from the detonator when the non-pyrotechnic firing line is pulled from the housing.

2. An explosive device as claimed in claim 1, in which the non-pyrotechnic firing line is coiled within the housing.

3. An explosive device as claimed in claim 2, in which the non-pyrotechnic firing line is coiled as a series of radially nested helices.

4. An explosive device as claimed is claim 1, in which the other end of the non-pyrotechnic firing line is attached to a tag.

5. An explosive device as claimed in claim 1, in which the other end of the non-pyrotechnic firing line extends from within the housing and is releasably fixed to the outside of the housing or explosive charge body.

6. An explosive device as claimed in claim 1, in which the housing comprises a thin sleeve which is slide-fit over the explosive charge body and, is retained in position by a strip of adhesive tape.

7. An explosive device as claimed in claim 1, in which the explosive charge is a shaped charge.

8. An explosive device as claimed in claim 1, in which the explosive charge is a blast charge.

9. An explosive device as claimed in claim 8 in which the detonator is embedded in the explosive charge and the non-pyrotechnic firing line first extends from the detonator away from the housing before it loops back towards housing.

10. An explosive device as claimed in claim 1, including an elongate support attached to the explosive charge body.

11. An explosive device as claimed in claim 1, in which the non-pyrotechnic firing line is a non-electrical detonation transmission line.

12. An explosive device as claimed in claim 1, in which either:

a) the non-pyrotechnic firing line is threaded through two or more holes in the charge body;

b) there is a tether connecting the non-pyrotechnic firing line to the charge body; or c) the non-pyrotechnic firing line is fixed to the outside of the charge body by means of adhesive tape, adhesive or other fastening or fixing means.

13. A method of disturbing a snow or ice formation using an explosive device comprising an explosive charge body including an explosive charge and a detonator; a housing; and a length of non-pyrotechnic firing line having a first end and a second end, one end being operatively connected to the detonator, the majority of which line is stored within the housing so as to permit progressive removal from the housing on pulling one of the ends thereof; and in which movement of the non-pyrotechnic firing line is restrained so as to prevent the one end of the non-pyrotechnic firing line being pulled away from and operatively disconnected from the detonator when the non-pyrotechnic firing line is pulled from the housing, said method comprising deploying the explosive charge body at or near a desired location with the non-pyrotechnic firing line extending from the explosive charge to an initiation site and then detonating the explosive charge.

14. The method of claim 13 including adjusting the position and/or orientation of the explosive charge body using the non-pyrotechnic firing line and detonating the explosive charge prior to detonation of the explosive charge.

15. The method of claim 13, in which the explosive charge body is hand-launched by the user to deploy the explosive charge body.

16. The method of claim 13, in which the explosive charge body is launched by a launching device to deploy the explosive charge body.

17. The method claimed in claim 13, wherein the other end of said non-pyrotechnic firing line is attached to a tag, and in which the tag is attached to an anchor.

18. The method claim 14 in which the explosive charge body is launched so the non-pyrotechnic firing line lies over a support, and the step of adjusting the position of the explosive charge body includes pulling the non-pyrotechnic firing line until the device is at a desired height above the snow.

19. The method as claimed in claim 13 wherein said explosive device includes an elongate support attached to the explosive charge body, said method further comprising:

positioning the support in the snow so the explosive charge body is in a desired position and orientation;

pulling the other end of the non-pyrotechnic firing line to firing position; and detonating the explosive charge.

20. The method of claim 19 wherein the other end of said non-pyrotechnic firing line is attached to a tag, and the tag is attached to an anchor carried by the user and the non-pyrotechnic firing line is pulled from the housing by the user moving away from the device.

21. The method as claimed in claim 15, in which the housing is retained at the launch site and the non-pyrotechnic firing line is pulled from the housing by the explosive charge body when launched.

* * * * *